US006056160A

United States Patent [19]

Carlucci et al.

[11] Patent Number: 6,056,160

[45] Date of Patent: May 2, 2000

[54] HEATED FOAMING LIQUID DISPENSING APPARATUS

[75] Inventors: Vito James Carlucci; Harold R. Taylor, both of Stratford, Conn.

[73] Assignee: Conair Corporation, Stamford, Conn.

[21] Appl. No.: 09/268,102

[22] Filed: Mar. 12, 1999

[51] Int. Cl.[7] ..... B67D 5/62

[52] U.S. Cl. ..... 222/146.3; 222/146.5; 222/325; 222/402.13; 222/402.15; 219/214; 219/432; 219/535

[58] Field of Search ..... 219/432, 535, 219/214; 222/325, 146.5, 146.3, 402.13, 402.15

[56] References Cited

U.S. PATENT DOCUMENTS

| | | | |
|---|---|---|---|
| 3,578,945 | 5/1971 | Ayres | 222/146.5 X |
| 3,596,056 | 7/1971 | Dillarston | 219/214 X |
| 3,710,985 | 1/1973 | Baum | 222/146.3 X |
| 3,749,880 | 7/1973 | Meeks | 222/146.3 X |
| 3,846,614 | 11/1974 | Doyle et al. | 219/214 |
| 3,891,827 | 6/1975 | Wyse | 222/146.3 X |
| 3,933,276 | 1/1976 | Packham et al. | 222/146.5 |
| 3,990,612 | 11/1976 | Gasser | 222/146.5 |
| 3,997,083 | 12/1976 | McNair | 222/146.3 |
| 4,027,786 | 6/1977 | Ryckman, Jr. | 222/146.3 |
| 4,056,707 | 11/1977 | Farnam | 222/146.3 X |

*Primary Examiner*—Kenneth Bomberg
*Attorney, Agent, or Firm*—Ohlandt, Greeley, Ruggiero & Perle

[57] ABSTRACT

A dispenser for heating and dispensing, to a user through an outlet, a foaming liquid, such as shaving cream from a pressurized can of such cream. The foaming liquid, when initially heated in the dispenser's heat chamber may undesirably produce steam and or a runny liquid that would be dangerous or at least undesirable to a user. In accordance with the invention, a trap is placed near the outlet to capture the steam or runny liquid. Since shaving cream cans come in two lengths, in accordance with another aspect of the invention, a reversible end cap is disclosed which will retain either of two sizes of shaving cream in the dispenser.

18 Claims, 5 Drawing Sheets

HEATED FOAMING LIQUID DISPENSING APPARATUS

FIELD OF THE INVENTION

The present invention relates to a dispenser of foaming liquid such as shaving cream and, more particularly, to apparatus for heating the foaming liquid and dispensing it to a user in a safe manner, the dispenser accepting a plurality of sizes of foaming liquid container.

BACKGROUND OF THE INVENTION

Commercial hot lather dispensers have been available for many years and are most commonly found in barber shops. There, the consistency of the lather or other foaming liquid is known so the dispenser can be designed accordingly. Furthermore the size of the foaming liquid container, if any is used, is set, allowing for a appropriate sizing of the dispenser. Additionally the sales price can be rather high since it is for commercial purposes and must work reliably over many years of heavy usage.

In contrast, when designing a foaming liquid dispenser for the consumer market, the designer must allow for a wide variety of formulations of foaming liquid, must build the dispenser inexpensively so that its price will appeal to the consumer, and must allow for different size containers of foaming liquid.

First, with reference to the variety of foaming liquids on the market, it has been found that the dispenser heater, in order to heat an initial charge of some formulations of foaming liquid, that an overheating occurred to the point of producing steam and/or very runny liquid. The "initial charge" is the volume of foaming liquid that passes through the heating compartment when the user initiates discharge from a supply of foaming liquid.

Second, because of cost constraints, it is not economically feasible to have means for adjusting the heating temperature to accommodate the various brands of foaming liquid.

Third, home size shaving cream containers of various brands presently come in plural differing volumetric sizes which must be handled by the foaming liquid dispensing apparatus. The diameter of each size is often the same but there is difference in the length dimension of the containers. Obviously the sizes of container can vary at the whim of the respective brands' marketing staff.

SUMMARY OF THE INVENTION

In accordance with a preferred embodiment of the present invention, a dispenser for heating and dispensing, to a user, a foaming liquid comprises a heating means for providing heat to a foaming liquid, the heating means including a heating element positioned within a chamber sized to hold a volume V of foaming liquid, the chamber having an inlet port, and an outlet port. The inlet port is adapted to controllably receive a pressurized supply of foaming liquid which travels through the chamber and through the outlet port. The heating means heats the foaming liquid as the foaming liquid passes through the chamber.

The dispenser further comprises control means for controllably allowing and disallowing the foaming liquid to pass through the chamber, and a dispensing nozzle coupled to the outlet port for receiving heated foaming liquid therefrom. The nozzle has an orifice through which the heated foaming liquid is dispensed to a user, and is further provided with a trap chamber of volume not less than about volume V, for holding the initial charge of the heated, foaming liquid when the control means changes from a disallowing state to an allowing state. Thereby, the initial charge from the chamber is not immediately dispensed through the dispensing nozzle, but is rather collected in the trap chamber.

In an additional embodiment, a dispenser is disclosed for dispensing, to a user, a foaming liquid from a container thereof which container, when present, may be of a length dimension L1 or may be of a length dimension L2, greater than L1. The container has means for controllably releasing the foaming liquid. The dispenser comprises a chamber having an opening for receiving the container, and an end cap co-operable with the chamber and container. The end cap is configurable to secure the container of length dimension L1, when present, within the chamber and is reconfigurable to secure the container of length dimension L2, when present, within the chamber.

The dispenser further comprises a nozzle coupled to the means controllable to release the foaming liquid for passing the foaming liquid to the user, and control means coupled between the chamber and the means controllable to release the foaming liquid. The control means is operational to allow and disallow the passage of the foaming liquid from the container to and through the nozzle.

BRIEF DESCRIPTION OF THE DRAWINGS

FIGS. 1*a* and 1*b* illustrate cross-sectional views of a heated foaming liquid dispensing apparatus in accordance with the present invention with FIG. 1*a* depicting a relatively short can of foaming liquid while FIG. 1*b* depicts a relatively tall can of foaming liquid.

FIG. 3*a* illustrates a heat exchanger chamber used in the dispensing apparatus of FIGS. 1*a* and 1*b,* while

DETAILED DESCRIPTION OF THE INVENTION

Figure 1A:
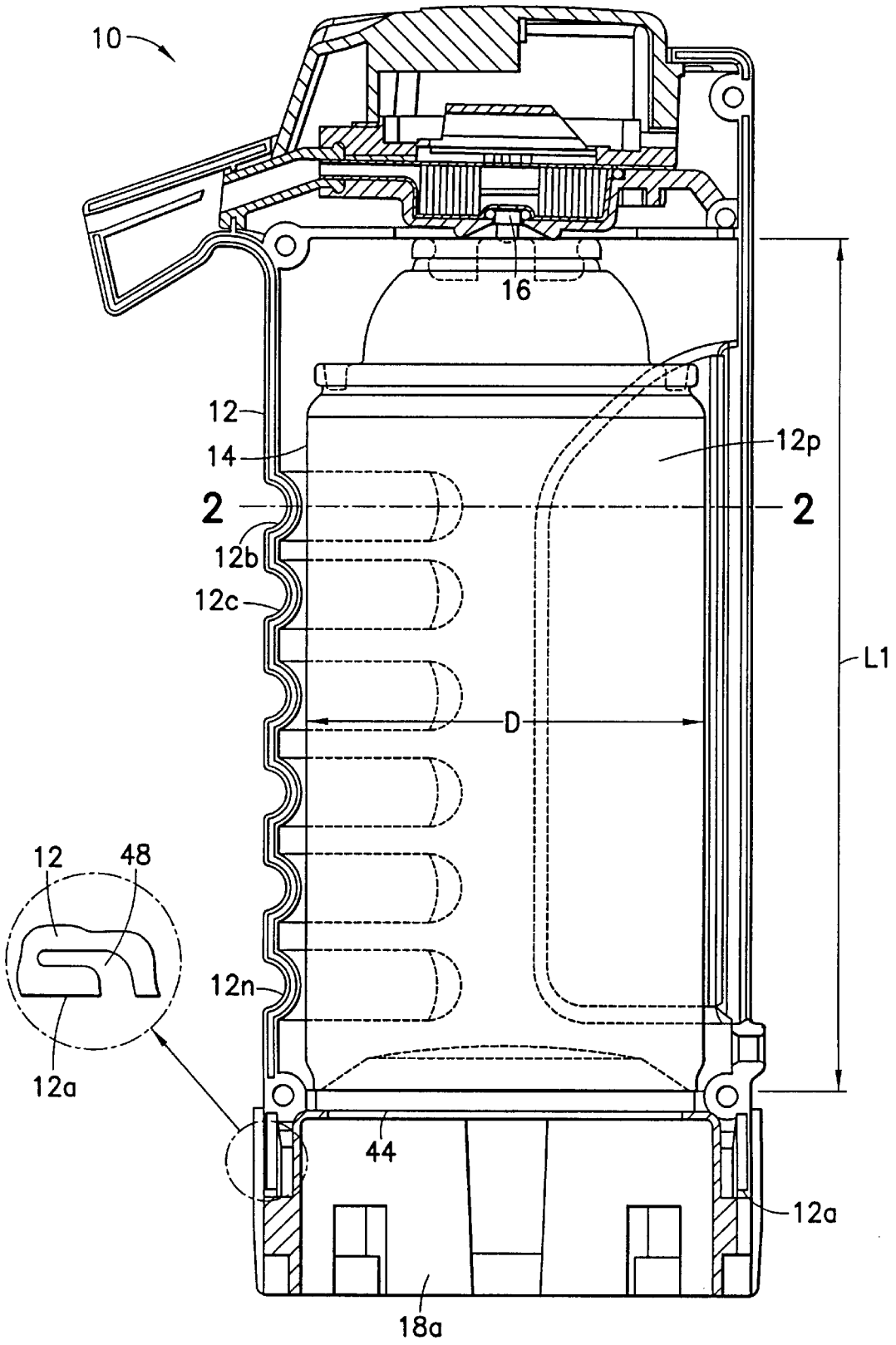

With reference to the drawings and particularly to FIG. 1*a,* a dispenser 10 of heated foaming liquid is shown in cross-section to comprise a chamber 12 open at one end 12*a,* for holding a pressurized container 14 of foaming liquid such as shaving cream. The container forms no part of the invention but is readily available in drug stores, grocery stores and the like.

Figure 1B:
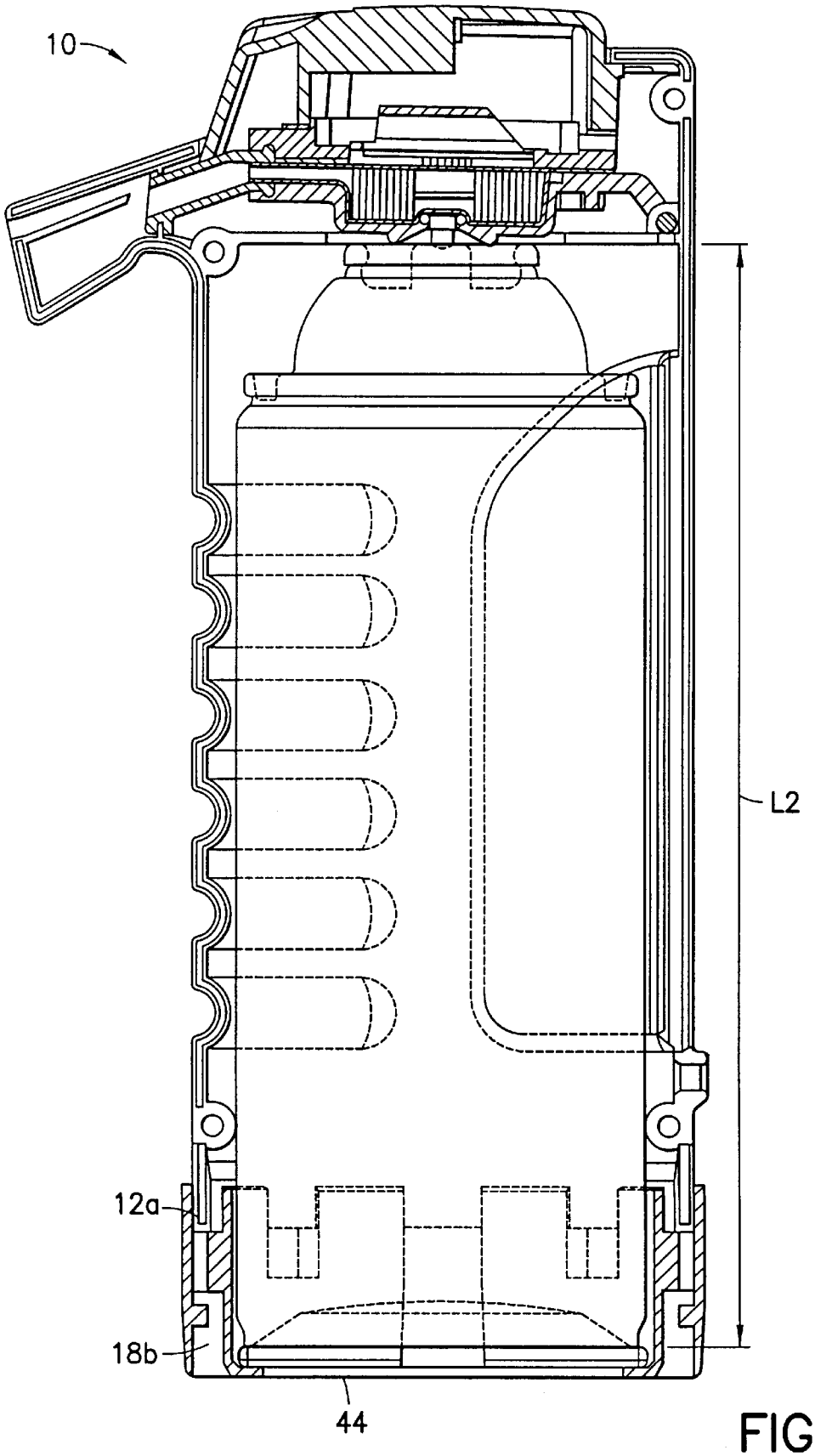

Exemplary containers are typically round and of one diameter D but of two elongated lengths L1 and L2. The container of length L1 shown in FIG. 1*a* holds 11 ounces of shaving cream while the container of length L2 as shown in FIG. 1*b* holds 14.75 ounces. These numbers are by way of example only. The only difference between FIG. 1*a* and FIG. 1*b* is the size of the illustrated container and the orientation of an end cap 18 (a or b) to be discussed in more detail hereinafter.

It should be noted that a shaving cream container, as manufactured, contains on one end thereof an outlet 16 through which foaming liquid is ejected (and which is better illustrated in FIG. 2 to be discussed hereinafter) and a dispensing nozzle (not shown) which is releasable secured to the container and is removed, typically by pulling the nozzle away from the container 14 before the insertion of container 14 into chamber 12. The container nozzle is discarded.

Container 14 is placed in chamber 12 such that the end of the container, with outlet 16, is placed first into chamber 12 at opening 12*a*. In conventional manner foaming liquid is dispensed whenever outlet 16 is depressed toward the body of container 14.

Chamber 12 is sculptured with indents 12*b*, 12*c* . . . 12*n*, making the foaming liquid dispenser relatively easy to grip. Chamber 12 is also sculptured with a relatively large indented area 12*p* again making the foaming liquid dispenser relatively easy to hold.

Figure 2:
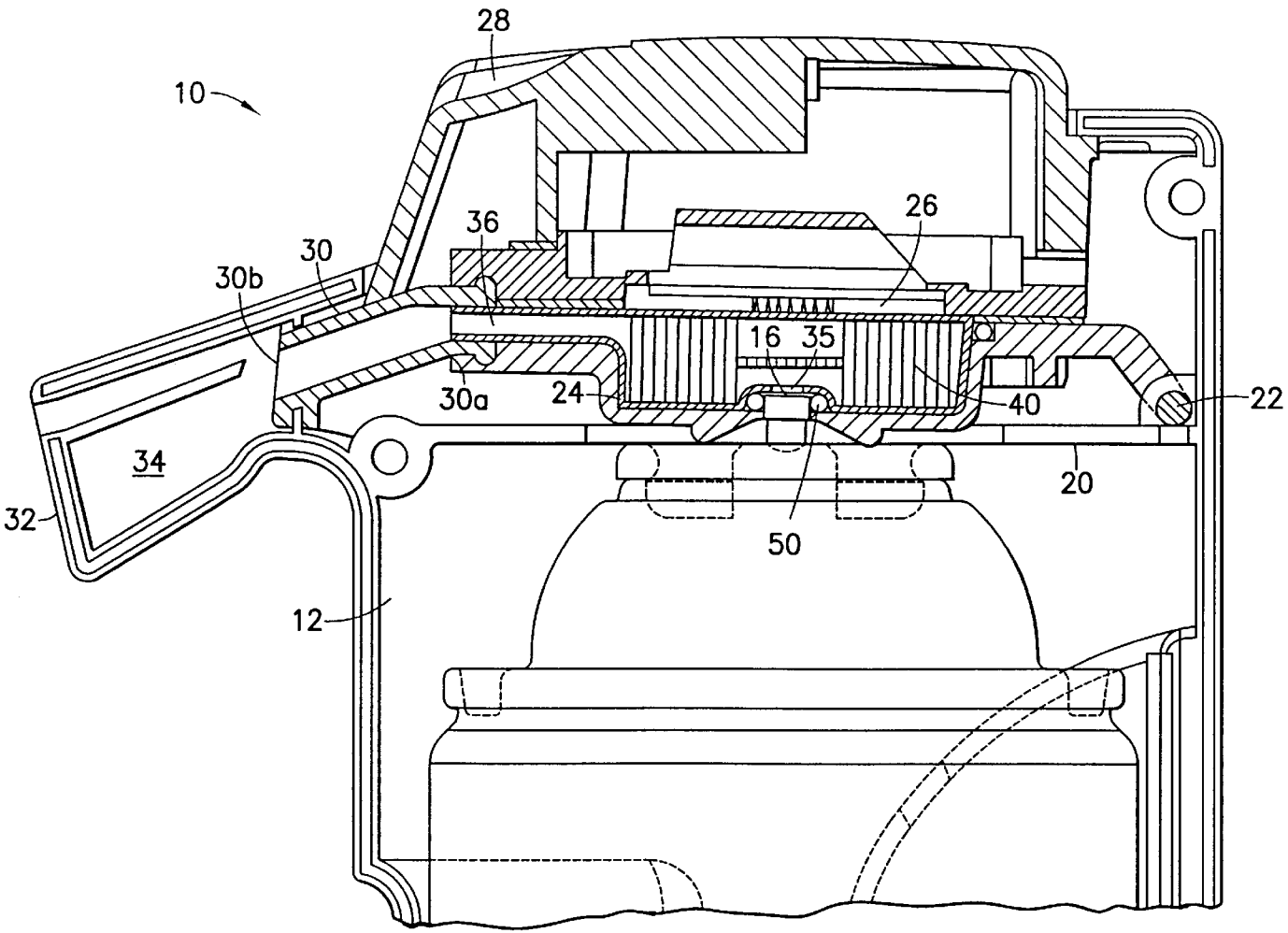
FIG. 2 illustrates a cross-section of the upper portion of the dispensing apparatus of FIGS. 1*a* and 1*b,* drawn to an enlarged scale.

Turning now to FIG. 2, the upper portion of dispenser 10 is shown in cross-section, that upper portion being the portion above line 2—2 in FIG. 1*a*. FIG. 2 is drawn to a larger scale than that used in FIG. 1*a* and 1*b* so that small parts are more readily seen. The top of container 14 rests against a stop element 20 which constitutes the top of chamber 12. Above element 20 (as illustrated in FIG. 2) are a number of elements which are all part of foaming liquid dispenser 10 and which are moveable together relative to chamber 12. In the illustrated embodiment the moveable elements are designed to pivot, under user control, about pin 22 which is in fixed relation to element 20 and thus to chamber 12. The moveable elements are a heat exchange chamber 24 containing a heat exchanging coil 40, a heating element 26, a push area 28 of a decorative dispenser cover 29 and one end portion 30*a* of a flexible foaming liquid exit tube 30.

The distal end 30*b* of tube 30 is in fixed relation with a dispensing nozzle 32 which is in fixed relationship with chamber 12 and thus in fixed relationship with element 20. Nozzle 32 includes a trap area 34 and a dispensing orifice 36. FIG. 2 illustrates that the position of tube 30 relative to nozzle 32 is such that any material including, but not limited to foaming liquid which exits tube distal end 30*b* (how this occurs will be described hereinafter) is directed first into trap 34 and then, when trap 34 is full, out of orifice 36 to a user.

Trap area 34 has a net volume not less than approximately the net volume of chamber 24, that is, the volume of chamber 24 less the volume of heat exchanging coil 40.

Heat exchanger chamber 24 includes an inlet port 35, as illustrated in an enlarged view of a portion of FIG. 2, and an outlet port 36 which is coupled to tube 30 at end 30*a* thereof. As above described, chamber 24 contains a heat exchanging coil 40. Coil 40 is best illustrated in FIGS. 3*a* and 3*b* to which attention is now directed.

Figure 3A:
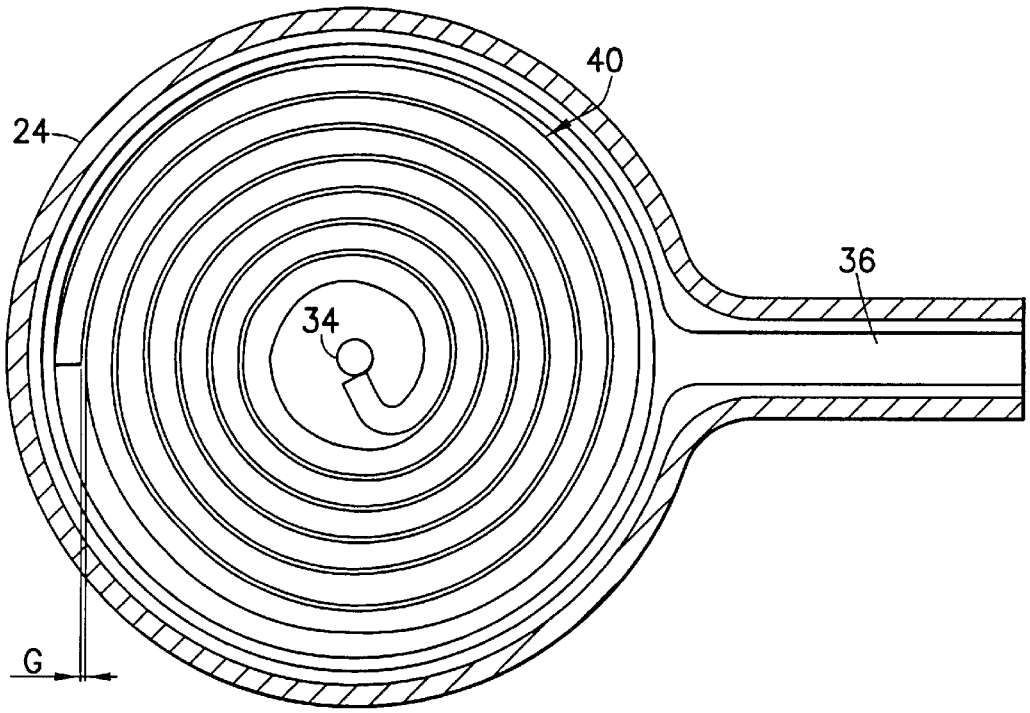
Figure 3B:
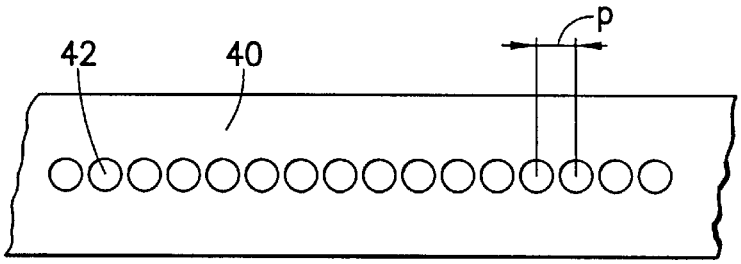
FIG. 3*b* illustrates a detail of one component of the heat exchanger chamber.

FIG. 3*a* is a top view, relative to the view in FIG. 2 of the heat exchange chamber 24 and of spiral wound heat exchanging coil 40. Coil 40 is typically made of sheet aluminum having spaced dimples 42 at pitch p as best illustrated in FIG. 3*b* to keep successive turns of coil 40 separated from one another. Dimples 42 are of height g to maintain gap g between successive turns of coil 40 as illustrated in FIG. 3*a*. By way of example and not by way of limitation g may be 0.3 mm and p may be 2.0 mm.

Although not illustrated in FIG. 3*a*, heating element 26 (FIG. 2) is positioned atop chamber 24 sealing the chamber except for the inlet port 34 and outlet port 35.

Figure 4B:
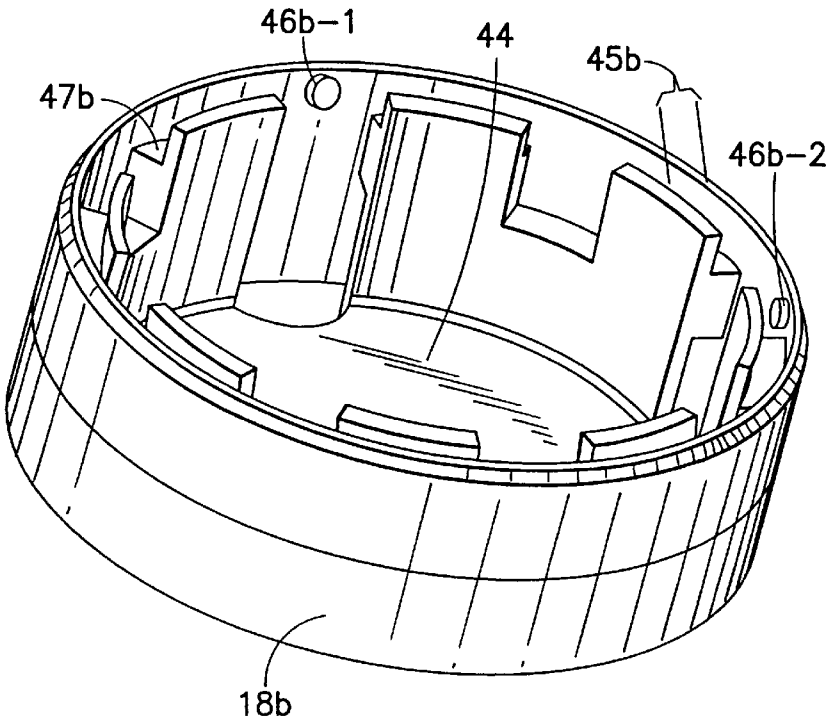
FIGS. 4*a* and 4*b* illustrate, in perspective, an end cap in two flipped orientations for closing the bottom end of the dispensing apparatus containing two different sizes of containers as illustrated in FIGS. 1*a* and 1*b*.
Figure 4A:
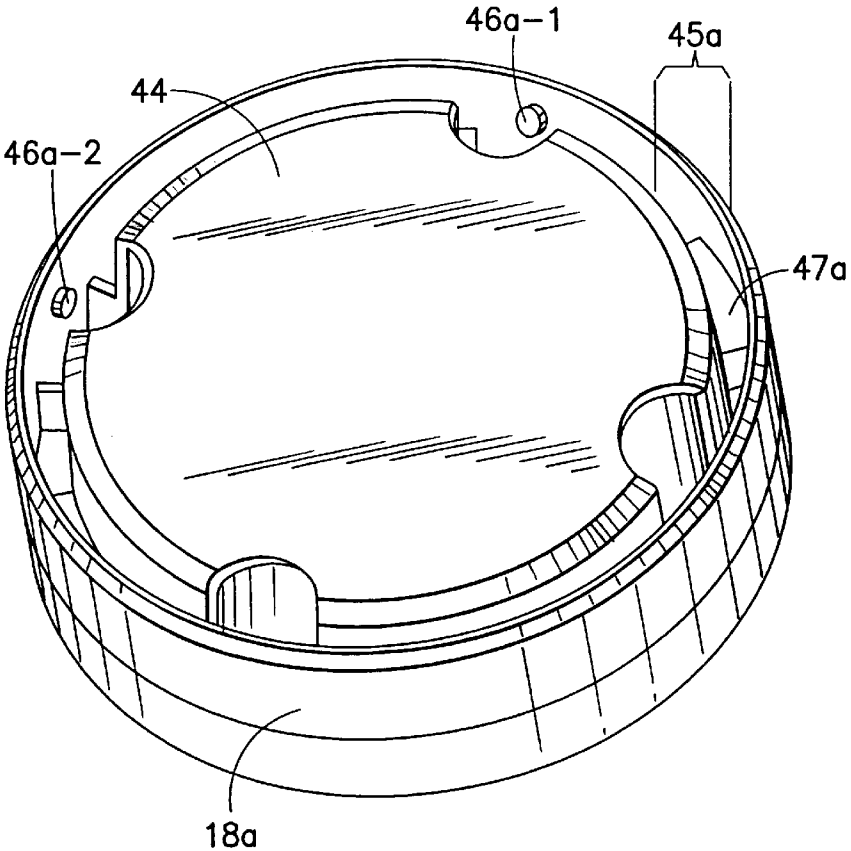

With attention now to FIGS. 1*a*, 1*b*, 4*a* and 4*b*, end caps 18 (18*a* and 18*b*) shown in FIGS. 4*a* and 4*b* are identical but flipped top to bottom, as illustrated in FIGS. 4*a* and 4*b*, respectively. Cap 18 includes a platform 44 that is at the top of the cap in FIG. 4*a* and in the bottom of the cap in the flipped orientation shown in FIG. 4*b*. Cap 18 also includes a plurality of inwardly directed, periodically spaced bosses 46 around periphery 18*p* of cap 18 of which two, 46*a*-1 and 46*a*-2, are illustrated in FIG. 4*a* and two others, 46*b*-1 and 46*b*-2 are illustrated in FIG. 4*b*. Cap 18 also includes a channel 45*a*, 45*b* around the circumference of the cap and includes a plurality of stops, 47*a*, 47*b* being exemplary. The stops 47 are a fixed distance below bosses 46 as viewed in either FIG. 4*a* or 4*b*.

Referring back to FIGS. 1*a* and 1*b* it will be seen that cap 18*a* closing the bottom of the chamber in FIG. 1*a* is orientated as in FIG. 4*a* while the identical cap 18*b* closing the bottom of the chamber in FIG. 1*b* is orientated as in FIG. 4*a*. Because of the two orientations, a relatively short container 14 of foaming liquid is accommodated as illustrated in FIG. 1*a* and a relatively longer container 14 of foaming liquid is accommodated as illustrated in FIG. 1*b*.

The bosses 46*a*-x or 46*b*-x, where x=1, 3 . . . n, n being typically 3 or 4, cooperate with a like number of slots (one, 48, shown in an expanded view of a portion of FIG. 1 (a or b)) near the bottom rim 12*a* of chamber 12 such that by twisting cap 18 the cap is secured to chamber 12. Also the bottom 12*a* of chamber 12 rests against stops 47*a* or 47*b* respectfully (FIG. 4) This arrangement insures that the cap 18 will stay in place on chamber 12 and insures that the top of container 14 is held tightly against element 20. Were it not for the reversibility of cap 18, two different means would be required to handle two sizes of foaming liquid and that would increase the likelihood that one would get lost.

Operation of the dispenser is as follows. A source of foaming liquid is sealingly coupled to inlet port 34 of chamber 24. Most often this source is a pressurized shaving cream can 14, with the supplied nozzle discarded. The shaving cream can is inserted into chamber 12 and end cap 18 secured in place on chamber 12 as previously described such that outlet 16 is sealed by 0-ring 50 and the top of outlet 16 is against chamber 24 in line with port 34 thereof.

With reference to FIG. 2 power is applied from a wall outlet or other source of power via power cord 56 to heater 26. A switch (not shown) is user operated to apply power to heater coil 40 and when it reaches a desired heat level, an indicator is lighted to signal the user that the dispenser is ready for use.

Before the dispenser is used for the first time, there is no foaming liquid inside chamber 24 but the chamber may be filled with water or vapor. Thus when power is applied to heater 26, steam may be ejected out of outlet port 36 and thus out of tube 30. If the steam had nowhere else to go, it would exit orifice 36 and could scald a user. But in accordance with the invention, the steam goes into the trap 34. Because the volume of the trap area is not appreciably less than the net volume V of chamber 24 (net volume is the gross volume of the chamber 24 less the volume occupied by coil 40), the initial shot of steam is diffused by the action of swirling in the trap.

Likewise when push area 28 is depressed by pivoting about pin 22, chamber 24 presses down on nozzle 16 of can 14 causing foaming liquid to be forced through the interstices of heat exchange coil 40 and out of outlet port 36 and flexible tube 30 while being heated by heater 26. The initial charge of approximately volume V fills trap area 34, and continued flow of now heated foaming liquid will exit orifice 36. Thus, the initial charge of foaming liquid, which may have become overheated, is held in trap 34, allowing subsequently heated foaming liquid to escape through nozzle 36.

The next time the dispenser is used, the foam in chamber 24 will have dried and left a small amount of residue. Thus when push area 28 is depressed causing new foaming liquid to be dispensed, the initial charge is again directed to trap area 34, etc. Accordingly, in accordance with the invention, only foaming liquid of proper temperature and consistency is ejected from orifice 36.

It will be understood that the particular source of foaming liquid is not important but a standard pressurized container is exemplary. The foaming liquid could be from another source such as a bulk container with a tube, and perhaps a pressurizing pump, running to the area where outlet 16 is located or the foaming liquid could be mixed on the spot as needed. Likewise shaving cream is only one example of the more generic term "foaming liquid".

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A dispenser for heating and dispensing to a user a foaming liquid, comprising:

heating means for providing heat to said foaming liquid, said heating means comprising a heating element;

a chamber sized to hold a volume V of foaming liquid, said chamber being in thermal contact with said heating element, said chamber having an inlet port, and an outlet port, said inlet port adapted to controllably receive a pressurized supply of said foaming liquid which is caused by said pressure to pass through said inlet port, through said chamber and through said outlet port, said heating means adapted to heat said foaming liquid as said foaming liquid passes through said chamber;

control means for controllably allowing and disallowing said foaming liquid to pass through said chamber; and a dispensing nozzle coupled to said outlet port for receiving heated foaming liquid therefrom, said nozzle having an orifice through which said heated foaming liquid is dispensed to a user, said nozzle further having a trap chamber of volume about volume V or greater, for holding an initial charge of said heated, foaming liquid when said control means changes from a disallowing state to an allowing state, whereby the initial charge from the chamber is not immediately dispensed through said dispensing nozzle but rather collected in said trap chamber.

2. A dispenser for dispensing, to a user, a foaming liquid from a container thereof which container, when present, may be of a length dimension L1 or may be of a length dimension L2, greater than L1, said container having means controllable to release said foaming liquid, said dispenser comprising:

a chamber having an opening for receiving said container;

an end cap co-operable with said chamber and container, said end cap being configurable to secure said container of length dimension L1, when present, within said chamber, and reconfigurable to secure said container of length dimension L2, when present, within said chamber;

a nozzle coupled to said means controllable to release said foaming liquid for passing said foaming liquid, when released, to said user; and control means coupled between said chamber and said means controllable to release said foaming liquid, said control means being operational to allow and disallow the passage of said foaming liquid from said container to and through said nozzle.

3. The combination as set forth in claim 1 wherein said pressurized supply of foaming liquid is in a container and wherein said dispenser further includes a chamber sized for receiving said container.

4. The combination as set forth in claim 3 and further including an end cap co-operable with said chamber to retain said container, when present, in said chamber.

5. The combination as set forth in claim 4 and wherein said container includes first and second opposing ends and has either one of a dimension L1 and a different dimension L2 measured between said first end and said second end, said end cap being configured to hold either size container securely in said chamber.

6. The combination as set forth in claim 5 wherein said container is of generally elongated shape having a generally circular cross-section and having first and second opposed ends and wherein each of said dimension L1 and said dimension L2 is measured between said first and second ends and wherein said chamber has a generally cylindrical opening sized to accept said container and being of length approximately L1 and wherein said end cap is configured to cooperate with said chamber to secure a container of length L1 in said chamber and also configured to cooperate with said chamber opening to secure a container of length L2 in said chamber.

7. The combination as set forth in claim 6 wherein said end cap is in a first orientation when securing a container of dimension L1 and in a second different orientation when securing a container of dimension L2.

8. The combination as set forth in claim 1 wherein said chamber comprises a heat exchanger for transferring heat from said heating means to said foaming liquid as it is passed through said chamber.

9. The combination as set forth in claim 8 wherein said foaming liquid is supplied in a container, and said dispenser also includes a container chamber for holding said container, said container having a controllable dispensing nozzle which is coupled to said chamber inlet port.

10. The combination as set forth in claim 9 wherein said control means both controls said controllable dispensing nozzle to release said foaming liquid into said chamber and concurrently connects an external source of energy to said heating means for heating the same and in turn heating the foaming liquid in said chamber.

11. The combination as set forth in claim 10 wherein said control means pivots about a portion of said dispenser to control the release of said foaming liquid from said container.

12. The combination as set forth in claim 11 wherein said heating means and chamber means are secured to said control means for movement therewith.

13. The combination as set forth in claim 1 wherein said chamber outlet port is designed to direct said foaming liquid toward said trap chamber of said dispensing nozzle such that when said control means changes to said allowing state, said foaming liquid first fills said trap chamber then the excess is propelled through said orifice to said user.

14. The combination as set forth in claim 13 wherein said chamber comprises a heat exchanger for transferring heat from said heating means to said foaming liquid as it is passed through said chamber.

15. The combination as set forth in claim 14 wherein said foaming liquid is supplied in a container, and said dispenser also includes a container chamber for holding said container, said container having a controllable dispensing nozzle which is coupled to said chamber inlet port.

16. The combination as set forth in claim 15 wherein said control means both controls said controllable dispensing nozzle to release said foaming liquid into said chamber and concurrently connects an external source of energy to said heating means for heating the same and in turn heating the foaming liquid in said chamber.

17. The combination as set forth in claim 16 wherein said control means pivots about a portion of said dispenser to control the release of said foaming liquid from said container.

18. The combination as set forth in claim 17 wherein said heating means and chamber means are secured to said control means for movement therewith.

* * * * *